US009700081B2

(12) United States Patent
Tempesta

(10) Patent No.: US 9,700,081 B2
(45) Date of Patent: Jul. 11, 2017

(54) WRAP BACK BRA

(71) Applicant: NIKE, Inc., Beaverton, OR (US)

(72) Inventor: Laura Tempesta, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/845,655

(22) Filed: Sep. 4, 2015

(65) Prior Publication Data

US 2016/0081398 A1 Mar. 24, 2016

Related U.S. Application Data

(60) Provisional application No. 62/050,990, filed on Sep. 16, 2014.

(51) Int. Cl.

| | |
|---|---|
| ***A41C 3/00*** | (2006.01) |
| ***A41F 1/00*** | (2006.01) |
| ***A41C 3/02*** | (2006.01) |

(52) U.S. Cl.

CPC ..... *A41C 3/0057* (2013.01); *A41C 3/0028* (2013.01); *A41C 3/0035* (2013.01); *A41C 3/02* (2013.01); *A41F 1/006* (2013.01)

(58) Field of Classification Search

CPC ..... A41D 1/14; A41C 3/00; A41C 3/0028; A41C 3/0057; A41C 3/148; A41C 3/0007

USPC ..... 450/83–87; 2/210–212, 220, 221, 2/235–237

See application file for complete search history.

(56) References Cited

U.S. PATENT DOCUMENTS

| | | | | |
|---|---|---|---|---|
| 1,306,595 | A | 6/1919 | Jerome | |
| 1,530,504 | A * | 3/1925 | Lenkowsky | A41D 1/14 2/211 |
| 1,681,119 | A * | 8/1928 | Kennedy | A41C 3/00 450/85 |
| 2,364,899 | A | 12/1944 | Hatton | |
| 2,402,835 | A | 6/1946 | Nagy | |
| 2,542,881 | A | 2/1951 | Ries | |
| 2,970,597 | A | 2/1961 | Milton | |
| 3,256,886 | A | 6/1966 | Sachs | |
| 3,306,299 | A * | 2/1967 | Paramore | A41C 3/0007 2/67 |

(Continued)

OTHER PUBLICATIONS

International Search Report with Written Opinion dated Jan. 26, 2016 in Application No. PCT/US2015/048939, 15 pages.

(Continued)

*Primary Examiner* — Gloria Hale

(74) *Attorney, Agent, or Firm* — Shook, Hardy & Bacon L.L.P.

(57) ABSTRACT

A sport bra having an adjustable underband tightening assembly is provided herein. The sport bra comprises a front portion having a pair of breast cups, a pair of shoulder straps, and a front underband segment comprising a first wing extending away from a first side of the front underband segment and terminating in a first free end and a second wing extending away from a second side of the front underband segment and terminating in a second free end. The sport bra further comprises a back portion having a central body portion, a pair of shoulder straps secured to the shoulder straps of the front portion, and a back underband segment unaffixed to the front underband segment in an un-worn configuration.

16 Claims, 8 Drawing Sheets

(56) References Cited

U.S. PATENT DOCUMENTS

| | | | | |
|---|---|---|---|---|
| 3,378,013 | A * | 4/1968 | Bruno | A41C 3/00 450/58 |
| 3,465,754 | A | 9/1969 | Lockwood | |
| 3,771,528 | A | 11/1973 | May | |
| 4,781,651 | A | 11/1988 | Ekins | |
| D300,980 | S | 5/1989 | Mathis | |
| 5,045,019 | A | 9/1991 | Capasso et al. | |
| 5,180,326 | A * | 1/1993 | Williams | A41C 3/148 2/73 |
| 5,863,236 | A | 1/1999 | Johnson | |
| 5,908,346 | A | 6/1999 | McCall et al. | |
| 6,023,785 | A * | 2/2000 | Johnson | A41C 3/0057 2/62 |
| 6,068,538 | A | 5/2000 | Alleyne et al. | |
| 6,431,947 | B1 | 8/2002 | Henz | |
| 6,572,437 | B1 | 6/2003 | Waitz | |
| D575,026 | S | 8/2008 | Tonsor | |
| D597,278 | S | 8/2009 | Cavosie | |
| 8,337,275 | B2 * | 12/2012 | Martins-Crawbuck | A41C 3/0028 450/62 |
| 8,690,634 | B2 | 4/2014 | Heath et al. | |
| D739,642 | S * | 9/2015 | Valencia | D2/707 |
| 2006/0089083 | A1 | 4/2006 | Tonsor | |
| 2009/0233522 | A1 * | 9/2009 | Schlatmann | A41C 3/0057 450/39 |
| 2011/0117818 | A1 | 5/2011 | Barnard | |
| 2011/0177757 | A1 | 7/2011 | Swendseid | |
| 2011/0201252 | A1 | 8/2011 | Campbell | |

OTHER PUBLICATIONS

Non-Final Office Action dated Nov. 4, 2016 in U.S. Appl. No. 14/845,666, 10 pages.

* cited by examiner

WRAP BACK BRA

CROSS-REFERENCE TO RELATED APPLICATIONS

This application entitled "Wrap Back Bra" claims the benefit of priority to U.S. Provisional Application No. 62/050,990, filed Sep. 16, 2014 and entitled "Wrap Back Bra." The entirety of the aforementioned application is incorporated by reference herein.

This application entitled "Wrap Back Bra" is related by subject matter to concurrently filed U.S. patent application Ser. No. 14/845,666, entitled "Wrap Front Bra." The entirety of the aforementioned application is incorporated by reference herein.

BACKGROUND

Racerback sport bras may be advantageous in sport activities because their configuration enables a wide range of movement of the back and arms of the wearer without strap slippage. In contrast to more traditional bras that clasp in the back or front, racerback sport bras are typically constructed as a unitary piece that is donned by pulling over a wearer's head and doffed the same way. More specifically, typical racerback sport bras generally comprise a unitary main body panel that extends in a continuous circle around the front, sides and the back of a wearer when worn. Because these types of sport bras are generally constructed from elasticized fabrics to ensure a tight fit and adequate support, this configuration may make it difficult to both don and doff the sport bra. This is particularly true when the sport bra or the wearer is saturated with perspiration. Moreover, because a typical racerback sport bra utilizes a single main body panel, there is no ability to adjust the girth of the sport bra to provide customized support.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed toward a racerback sport bra configured to be easily donned and doffed and configured to have a customizable girth. In exemplary aspects the sport bra, in an as-constructed but un-assembled configuration, comprises a front portion and a back portion, where the front portion is unaffixed to the back portion except for a pair of shoulder straps. In other words, unlike conventional racerback sport bras where the bra comprises a unitary main body panel that generally extends in a continuous circle around the front, sides and the back of a wearer when worn, the front portion of the bra described herein is not joined to the back portion of the bra along the sides of the bra but instead comprises a separate piece from the back portion except for the shoulder strap connection. When in an as-worn and assembled configuration, an underband segment of the front portion of the bra may be releasably and adjustably affixed to an underband segment of the back portion by an adjustable underband tightening assembly. The adjustable underband tightening assembly described herein enables the girth of the sport bra to be increased while donning and doffing and then decreased once it is on a wearer's body so that the bra fits snugly and provides adequate support. The adjustable underband tightening assembly described herein further enables the wearer to adjust the girth of the bra during wear to accommodate different activities and/or movements.

In exemplary aspects, the sport bra may comprise a front portion having a pair of breast cups, a pair of shoulder straps, and a front underband segment, and a back portion having a central body region, a pair of shoulder straps that, in an as-constructed arrangement are fixedly or releasably secured to the shoulder straps of the front portion, and a back underband segment. In exemplary aspects, the adjustable underband tightening assembly may comprise extensions of the front underband segment (hereinafter known as "wings") that extend away from the front underband segment of the sport bra and terminate in a first free end and a second free end. The wings are configured to be wrapped around the sides of a wearer to the back of the wearer and releasably and adjustably secured to, for instance, the back underband segment of the back portion. When donning or doffing the sport bra, the wings can be adjustably loosened or even released thereby allowing the girth of the sport bra to increase which eases the process of donning and doffing the sport bra. Moreover, during wear, the wings can be loosened and/or tightened to provide customized support to the wearer.

BRIEF DESCRIPTION OF SEVERAL VIEWS OF THE DRAWINGS

The present invention is described in detail below with reference to the attached drawing figures, wherein.

DETAILED DESCRIPTION

Figure 1:
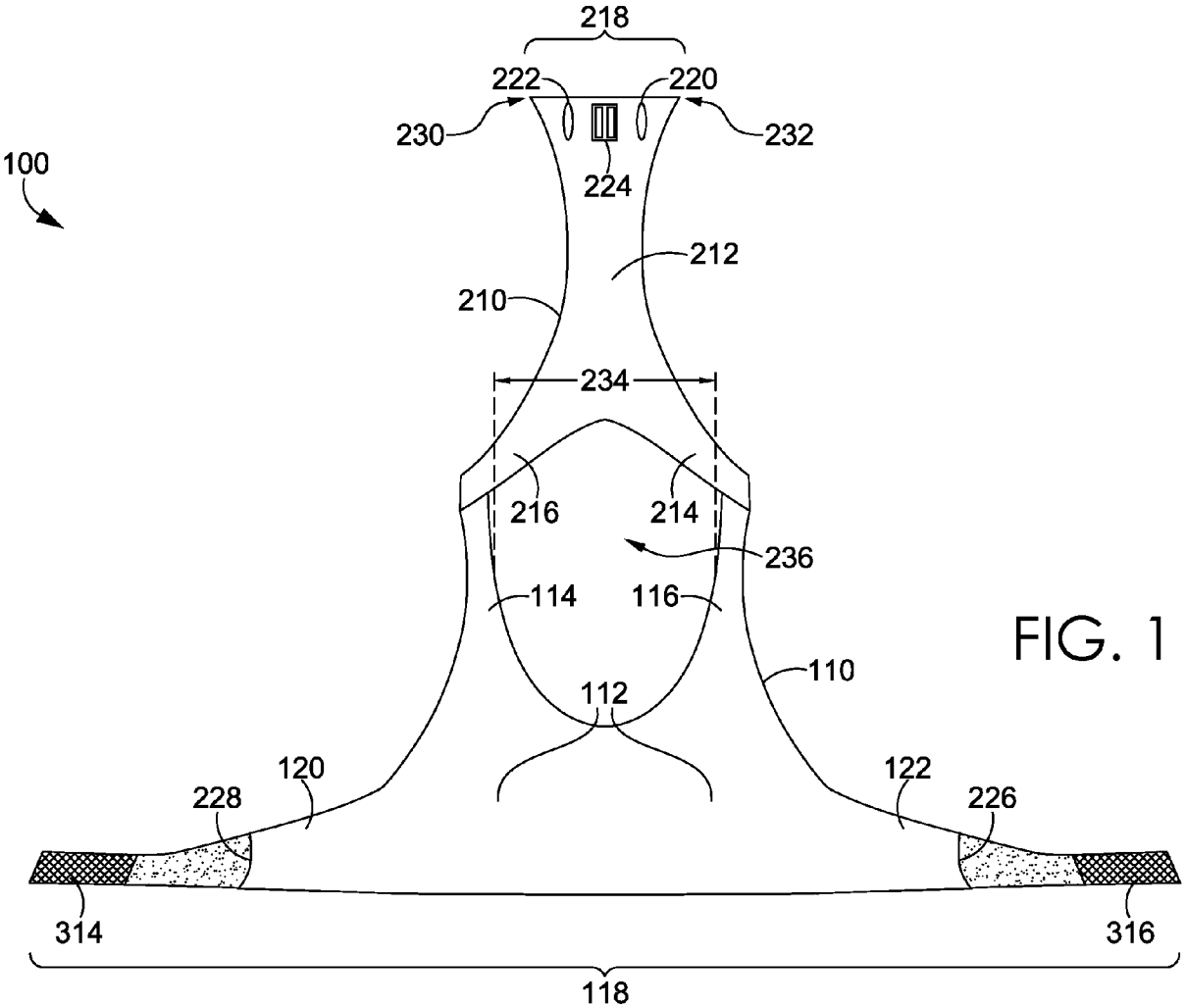
FIG. 1 illustrates a top view of an exemplary wrap back sport bra having an adjustable underband tightening assembly when in an un-assembled and laid-flat configuration in accordance with aspects hereof.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein provide for a sport bra having a front portion and a back portion where the front portion of the sport bra is unaffixed to the back portion of the sport bra except for a pair of shoulder straps when the sport bra is in an as-constructed but un-assembled configuration. The sport bra described herein comprises an adjustable underband tightening assembly that enables an underband segment of the front portion of the sport bra to be releasably and adjustably secured to an underband segment of the back portion of the sport bra when the sport bra is in an as-worn or assembled configuration. Moreover, by configuring the sport bra such that the underband segment of the front portion of the bra is releasably and adjustably secured to the underband segment of the back portion, the girth of the sport bra can be loosened when donning or doffing the sport bra and tightened once the sport bra is on a wearer's body thus allowing the sport bra to be more easily donned or doffed. To further facilitate the donning and doffing process, the adjustable underband tightening assembly may be used to generally disengage the front portion of the bra from the back portion of the sport bra when donning or doffing the sport bra. In this instance, the bra would be donned and doffed via the wearer inserting her head through the head opening created by the shoulder straps. Once donned, for instance, the wearer could adjustably and releasably secure the underband segment of the front portion to the underband segment of, for example, the back portion by using the adjustable underband tightening assembly. Further, once donned, the adjustable underband tightening assembly may allow the wearer to adjust the girth of the sport bra to, for example, provide increased support or to lessen the support if needed.

Exemplary sport bras having the adjustable underband tightening assembly described herein enable the wearer to select a sport bra having the needed cup size, and customize the sport bra to the wearer's particular girth by utilizing the adjustable underband tightening assembly. The use of the adjustable underband tightening assembly as described herein also benefits the manufacturer of the sport bra by decreasing the need to manufacture multiple bras having the same cup size but different girths.

In one illustrative aspect, the sport bra comprises a front portion having at least a pair of breast cups, a pair of shoulder straps, and a front underband segment located under the breast cups. As used throughout this disclosure, the term "breast cups" is meant to signify a general region of the sport bra that covers the wearer's breasts. The term "cup" is not meant to be limited to an actual cup-like structure as that term is used within the art, although cup-like structures are within the scope of the aspects discussed herein. Further, the pair of breast cups may comprise a single piece of material that covers both of the wearer's breasts and lacks a clear demarcation between the right breast region and the left breast region. In another example, the pair of breast cups may comprise a piece of material that primarily covers the right breast region and a piece of material that primarily covers the left breast region with a more defined demarcation between the two regions. Any and all such aspects, and any variation thereof, are contemplated as being within the scope herein. Further, as used throughout this disclosure, the term "underband" is meant to generally denote the lower or inferior portion of the sport bra when worn and may encompass the lower margin of the bra.

Continuing, the front underband segment extends from a lower margin of the breast cups and is adapted to cover a front portion of the wearer's torso under the wearer's breasts when the sport bra is worn. The front underband segment comprises in part a first wing and a second wing that extend away from respective first and second sides of the front underband segment and end in a first free end and a second free end respectively. In an exemplary aspect, the first and second free ends may have some type of releasable fastening mechanism located thereon such as, for example, hook-and-loop fasteners, buttons, snaps, hooks, eyes, adhesives, and the like.

The sport bra further comprises a back portion having a central body portion from which a pair of shoulder straps extends. The shoulder straps of the back portion may be fixedly or releasably secured to the shoulder straps of the front portion. The back portion further comprises a back underband segment located at the lower margin of the central body portion. In one exemplary aspect, the back underband segment may comprise a pair of apertures and a securing means, such as, for example, a double-loop slide buckle. Further, the securing means may be located adjacent to and between the apertures on an exterior face of the back portion. In other exemplary aspects, the back underband segment may not comprise the pair of apertures and the securing means, but, instead, may have other types of securing means used to adjustably and releasably secure the front underband segment to the back underband segment as will be explained in greater depth below.

In an as-worn configuration, each of the first and second free ends of the wings of the front underband segment may be wrapped around the sides of the wearer to the back underband segment and releasably and adjustably secured to the back underband segment. For instance, the free ends may be threaded or inserted through a respective aperture on the back underband segment such that the free ends are positioned on the exterior face of the back underband segment after being threaded through the apertures. The free ends may subsequently be threaded through a respective portion of the securing means, and folded back on themselves such that the releasable fasteners located on the free ends secure the wings at a specified length. The free ends may, in exemplary aspects, be tucked into a pocket or channel contained in the wing after being folded. This not only produces an aesthetically pleasing appearance to the sport bra but also prevents the free ends from potentially hanging down and impeding the wearer's performance and/or causing chaffing during movement.

In other exemplary aspects, the free ends of the front underband segment may be releasably and adjustably secured directly to the back underband segment via, for instance, a hook-and-loop mechanism, a hook-and-eye mechanism, snaps, buttons, releasable adhesives, and the like. In yet another exemplary aspect, the free ends of the front underband segment may be releasably and adjustably affixed directly to one another at the back portion of the bra.

Other exemplary configurations are contemplated herein. For instance, the front underband segment may comprise a pair of apertures and each of the wings may have a pocket or channel. The wings of the underband may be of such a length that after threading through the apertures and the securing means located on the back underband segment, the free ends of the wings are configured to be folded back on themselves and brought back around the sides of the wearer to the front underband segment of the sport bra. In one aspect, the pockets or channels located on the wings can be used as a conduit or channel through which the free ends are threaded when bringing the wings back around to the front underband segment. Once the free ends are brought back around to the front underband segment, the free ends can be threaded through the apertures located on the front underband segment and releasably and adjustably secured to an external surface of the front underband segment using some type of releasable fastener such as, for example, a hook-and-loop fastener strip located on the outer-facing surface of the front underband segment. Alternatively, the two free ends may be releasably and adjustably secured directly to each other using releasable fasteners. Using a pocket or channel as a conduit to guide the free ends/wings around to the front underband segment may prevent the wings from inadvertently chaffing the wearer during vigorous activity.

When a wearer wishes to don the sport bra, the wearer can loosen and/or disengage the front portion of the bra from the back portion of the bra by releasing or partially releasing the free ends of the wings of the front underband segment, adjusting the girth of the sport bra to a larger size, donning the sport bra by pulling the sport bra over the wearer's head, subsequently tightening the girth of the sport bra by pulling on the free ends until the desired girth is obtained. The free ends can then be releasably secured to, for instance, the back underband segment in some exemplary aspects and the front underband segment in other exemplary aspects. Doffing the sport bra would follow a similar series of steps (e.g., loosening the front portion of the bra from the back portion of the bra using the adjustable underband tightening assembly prior to pulling the sport bra over the wearer's head). The result is a sport bra that not only has a customizable girth, but also a sport bra that can easily be donned and doffed while still providing adequate support to the wearer's breasts during sports activities.

Turning now to FIG. 1, FIG. 1 illustrates a top plan view of an exemplary sport bra 100 having an adjustable underband tightening assembly in an un-assembled and laid-flat arrangement in accordance with aspects described herein. Although the term "un-assembled" is used in this disclosure, this term does not imply that the bra is an un-constructed state. Instead, this term means that the front portion is disengaged from the back portion except for the shoulder straps. While aspects discussed herein refer to bras, moreover, it will be understood that aspects are not limited to any particular style or type of support garment used to support breast tissue. For example, other support garments may comprise camisoles, swimwear, or other garments with built-in support. Further, the depictions in the drawings are for exemplary purposes only and are in no way meant to limit the scope of the aspects described herein.

The sport bra 100 comprises a front portion 110 and a back portion 210 fixedly or releasably secured to the front portion 110 by a set of shoulder straps 114, 116, 214, and 216. With respect to the front portion 110, the front portion 110 is adapted to cover a wearer's breasts and a portion of the wearer's torso when the sport bra 100 is worn. The front portion 110, in exemplary aspects, comprises breast cups 112, shoulder straps 114 and 116, and a front underband segment 118. The breast cups 112 may be structured or unstructured and are adapted to cover the wearer's breasts when the sport bra 100 is worn. The shoulder straps 114 and 116 extend from an upper region or margin of the breast cups 112 and are adapted to extend up to and/or over the wearer's shoulders when the sport bra 100 is worn. The material used to form the breast cups 112 and/or the shoulder straps 114 and 116 may comprise natural or man-made fibers having a degree of elasticity, compression, and/or stretch so as to provide support to the wearer's breasts when the sport bra 100 is worn.

The front underband segment 118 extends from a lower region or margin of the pair of breast cups 112 and is adapted to cover a front portion of the wearer's torso when the sport bra 100 is worn. In exemplary aspects, the front underband segment 118 comprises extensions or wings 120 and 122 that extend out from respective sides of the front underband segment 118. More specifically, the wing 120 extends out from and is contiguous with a respective first side of the front underband segment 118, and the wing 122 extends out from and is contiguous with a second opposite side of the front underband segment 118. The first wing 120 terminates in a first free end 314, and the second wing 122 terminates in a second free end 316.

Each wing 120 and 122 may comprise a pocket or channel 228 and 226 respectively. In exemplary aspects, the pocket or channel 226 and 228 may be created by, for example, affixing a separate panel on to an outer-facing or inner-facing surface of the wings 120 and 122 and/or the front portion 110 of the sport bra 100. Or, if the wings 120 and 122, and/or the front portion 110 are constructed of a woven or knit material, the pocket or channels 226 and 228 may be integrally formed via the weaving or knitting process. In exemplary aspects, the pockets or channels 226 and 228 may start a predefined distance from the free ends 314 and 316 such as a quarter of the way in from the free ends 314 and 316 and end a short distance later. In this aspect, the pockets or channels 226 and 228 may be sized to generally accommodate the free ends 314 and 316 of the wings 120 and 122 after the wings 120 and 122 have been folded back onto themselves as described above.

In exemplary aspects, each wing 120 and 122 may comprise a releasable fastener (indicated by cross-hatching) located on an outer-facing surface of the wings 120 and 122 adjacent to the free ends 314 and 316. Various releasable fasteners are contemplated herein such as hook-and-loop fasteners, buttons, releasable adhesives, snaps, hooks, eyes, and the like. As explained above, the releasable fasteners may be used to secure the ends 314 and 316 when the wings 120 and 122 are folded back on themselves after being threaded through a securing means as described above.

The front underband segment 118 and/or the wings 120 and 122 may be constructed of materials similar to those used to construct the breast cups 112 and the shoulder straps 114 and 116. That is, the front underband segment 118 and/or the wings 120 and 122 may be constructed from man-made or natural materials having a degree of elasticity, compression, or stretch. Alternatively, the front underband segment 118 and/or the wings 120 and 122 may be constructed of materials that exhibit little to no stretch, compression, or elasticity. Moreover, the breast cups 112, the front underband segment 118, and/or the wings 120 and 122 may be formed from a single panel of material or may be formed from multiple panels of materials that are affixed together utilizing affixing technologies known in the art (i.e., stitching, bonding, adhesives, welding, seam tape, and the like). Any and all such aspects, and any variation thereof, are contemplated as being within the scope herein.

The back portion 210 of the sport bra 100 may be cut in a racerback shape having a central body portion 212 adapted to be positioned generally between a wearer's shoulder blades when the bra 100 is in an as-worn configuration. Additionally, the back portion 210 comprises shoulder straps 214 and 216 and a back underband segment 218 having a first end 230 and a second end 232. The shoulder straps 214 and 216 extend from the upper margin of the central body portion 212 and are adapted to extend up to and/or over the wearer's shoulders when the sport bra 100 is worn. In an as-assembled configuration, the shoulder straps 214 and 216 may be releasably (i.e., via quick-release buckles) or fixedly secured (i.e., stitched to or bonded to) to the shoulder straps 114 and 116 of the front portion 110. When secured to the shoulder straps 114 and 116, the assembly of the shoulder straps 214 and 216 and the shoulder straps 114 and 116 define an orifice or opening 236 through which the wearer's head can be inserted or removed when donning or doffing the sport bra 100.

The back underband segment 218 generally comprises the lower margin of the central body portion 212. The back underband segment 218 may vary in length. In exemplary aspects, the back underband segment 218 may have a length such that the first and second ends 230 and 232 may be positioned generally along a mid-axillary line of a wearer when the bra 100 is in an as-worn configuration. In the exemplary aspect depicted in FIG. 1, the length of the back underband segment 218 as measured from the first end 230 to the second end 232 may be less than or equal to a diameter 234 of the opening 236 for the wearer's head as measured from a first lateral side of the opening 236 to a second lateral side of the opening 236. Moreover, in exemplary aspects, the length of the front underband segment 118 as measured from the first end 314 to the second end 316 may be greater than the diameter 234 of the opening 236 as measured from the first lateral side to the second lateral side. As such, in exemplary aspects, the length of the front underband segment 118 is greater than the length of the back underband segment 218.

In exemplary aspects, the back underband segment 218 comprises apertures 220 and 222, and a securing means 224. The apertures 220 and 222 may extend completely through the material making up the back underband segment 218 and are located on either side of an imaginary line that bisects the back portion 210 into two equal right and left halves. In an exemplary aspect, the securing means 224 may comprise a double-loop slide buckle that is affixed to an exterior face of the back underband segment 218 midway between the two apertures 220 and 222 (i.e., at a midpoint of the back underband segment 218) using various affixing technologies known in the art such as stitching, bonding, adhesives, and the like. The depiction of the securing means 224 in FIG. 1 is exemplary only and other types of securing means that releasably and adjustably help to secure the wings 120 and 122 to the back portion 210 are contemplated as being within the scope herein.

In exemplary aspects, the back portion 210 may be constructed separately from the front portion 110 and attached to the front portion 110 via, for example, the shoulder straps 214 and 216. For instance, the shoulder strap 214 may be releasably or fixedly attached to the shoulder strap 116, and the shoulder strap 216 may be releasably or fixedly attached to the shoulder strap 114. When constructed separately from the front portion 110, the back portion 210 may be formed from materials different from those used to form the front portion 110. For instance, the back portion 210 may be formed using mesh-like materials that provide breathability to the sport bra 100. In other exemplary aspects, the front portion 110 and the back portion 210 may be constructed from a single seamless piece of material through a knitting and/or weaving process. Any and all such aspects, and any variation thereof, are contemplated as being within the scope herein.

Figure 2:
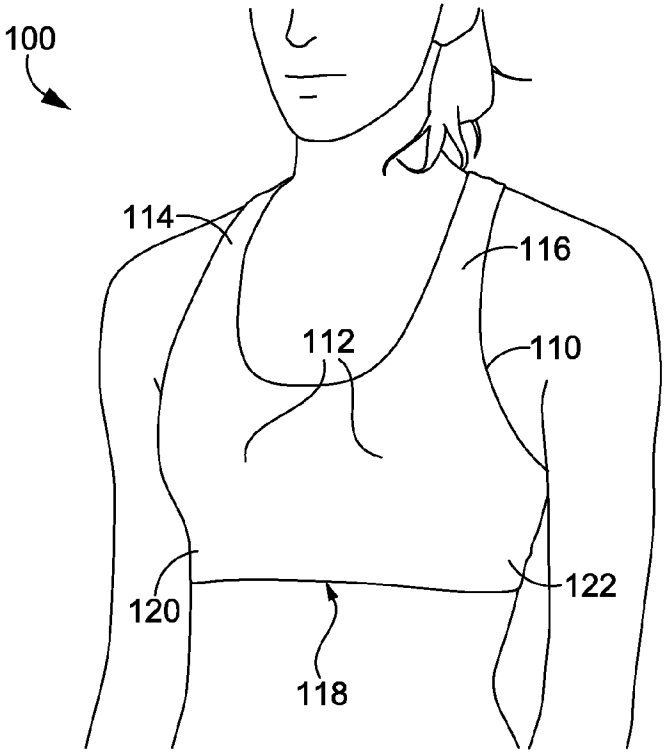
FIG. 2 illustrates a front perspective view of the exemplary sport bra having the adjustable underband tightening assembly of FIG. 1 in an as-worn position in accordance with aspects hereof.

Turning now to FIG. 2, FIG. 2 illustrates a front perspective view of a wearer wearing the exemplary sport bra 100 with the adjustable underband tightening assembly of FIG. 1 in accordance with aspects described herein. As depicted in FIG. 2, the front portion 110 of the bra 100 covers the wearer's breasts and a portion of the wearer's torso in the as-worn configuration. More specifically, the breast cups 112 are configured to substantially cover the wearer's breasts, the front underband segment 118 is configured to cover a portion of the wearer's torso below the wearer's breasts, the shoulder straps 114 and 116 are configured to extend up and/or over the wearer's shoulders, and the wings 120 and 122 are configured to wrap around the sides of the wearer.

Figure 3:
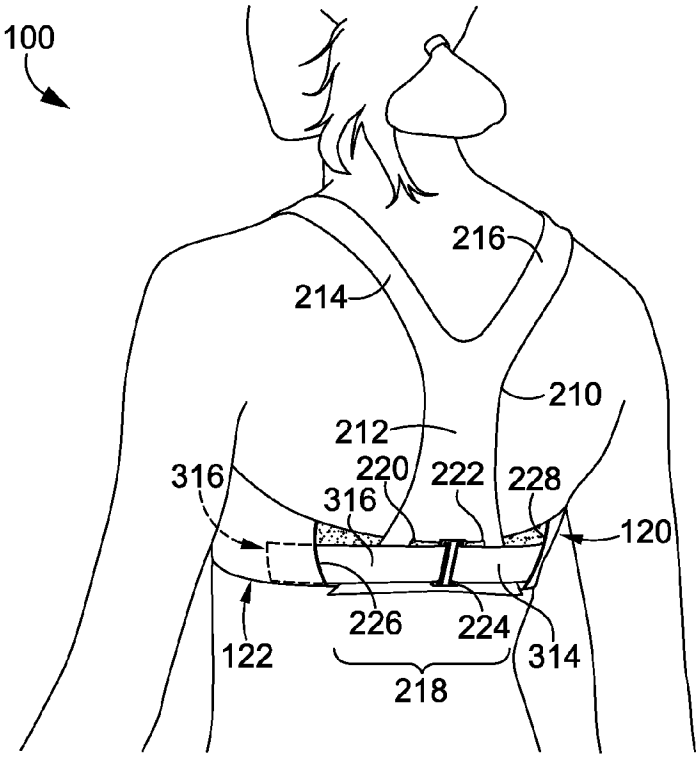
FIG. 3 illustrates a back perspective view of the exemplary sport bra having the adjustable underband tightening assembly of FIG. 1 in the as-worn position in accordance with aspects hereof.

FIG. 3 illustrates a back perspective view of the wearer wearing the exemplary sport bra 100 having the adjustable underband tightening assembly of FIG. 1 in accordance with aspects described herein. As illustrated in this view, the back portion 210 of the bra 100 is configured to cover a portion of the wearer's back in an as-worn configuration. More specifically, the central body portion 212 is configured to be positioned generally between the wearer's shoulder blades when the bra 100 is worn. The shoulder straps 214 and 216 extend from an upper margin of the central body portion 212 and are positioned adjacent the wearer's shoulders when the bra 100 is worn. As depicted, the back underband segment 218 generally comprises the lower edge of the central body portion 212 and is adapted to cover a portion of the wearer's torso when the bra 100 is worn. As described earlier, the back underband segment 218 comprises the apertures 220 and 222 and the securing means 224.

As is illustrated in FIG. 3, the wings 120 and 122 of the front underband segment 118 are configured to be wrapped around the sides of the wearer and brought underneath the back underband segment 218 such that the outer-facing surface of the wings 120 and 122 is adjacent to the inner-facing surface of the back underband segment 218. The free ends 314 and 316 of the wings 120 and 122 can then be threaded through the apertures 222 and 220 respectively. More specifically, the free ends 314 and 316 of the wings 120 and 122 can be threaded through an inner-facing portion of the apertures 220 and 222 and brought out through an external-facing portion of the apertures 220 and 222. Once threaded through the apertures 220 and 222, the ends 314 and 316 can be releasably and adjustably threaded through the securing means 224 and, for example, folded back onto themselves and secured using the releasable fastener located on the ends 314 and 316. The ends 314 and 316 can be tucked into the pockets or channels 226 and 228 located on the wings 122 and 120 as shown by the hidden lines for the end 316 that is tucked into the pocket or channel 226.

Figure 4:
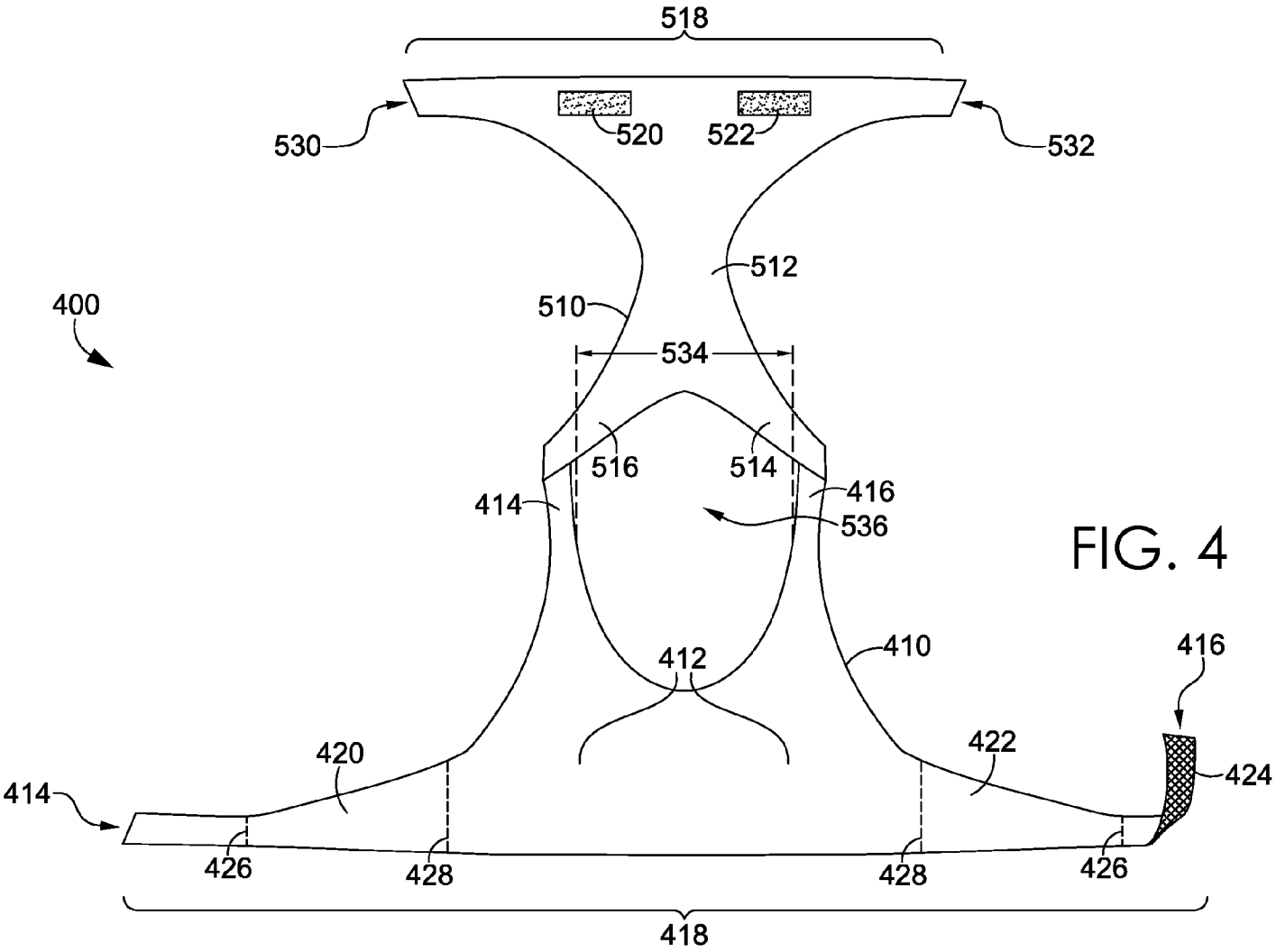
FIG. 4 illustrates a top view of an exemplary sport bra having an adjustable underband tightening assembly when in an un-assembled and laid-flat configuration in accordance with aspects hereof.

FIG. 4 illustrates another exemplary configuration for an exemplary sport bra 400 with an adjustable underband tightening assembly in an un-assembled and laid-flat configuration in accordance with aspects herein. The sport bra 400 shares some similar features as the sport bra 100. As such, the description of these similar features provided with respect to the sport bra 100 is equally applicable to the bra 400. The sport bra 400 comprises a front portion 410 affixed to a back portion 510 via a set of shoulder straps 414, 416, 514, and 516, where the set of shoulder straps 414, 416, 514, and 516 define an opening 536 through which a wearer's head can be inserted and/or removed.

The front portion 410 of the bra 400 comprises a pair of breast cups 412, a pair of shoulder straps 414 and 416 extending from an upper margin of the breast cups 412, and a front underband segment 418 extending from a lower margin of the breast cups 412. The front underband segment 418 comprises a pair of wings 420 and 422 that extend away from respective sides of the front underband segment 418 to terminate in a first free end 414 and a second free end 416. Each first and second end 414 and 416 may comprise a releasable fastener mechanism 424 located on an inner-facing surface of the wings 420 and 422 (indicated by cross-hatching). The releasable fastener 424, in exemplary aspects, may comprise a hook-and-loop fastener, a hook-and-eye fastener, buttons, snaps, a releasable adhesive, and the like. The releasable fastener 424 may be located just adjacent to the ends 414 and 416 as indicated by the dashed line 426 demarcating the ending point for the releasable fastener 424, or, optionally, the releasable fastener 424 may extend along the wings 420 and 422 of the front underband segment 418 as indicated by the dashed line 428 demarcating the ending point for the releasable fastener 424.

The back portion 510 of the bra 400 comprises a central body portion 512, a pair of straps 514 and 516 extending from an upper margin of the central body portion 512, and a back underband segment 518 having a first end 530 and a second end 532 extending from a lower margin of the central body portion 512. In exemplary aspects, the length of the back underband segment 518 as measured from the first 530 to the second end 532 may be greater than the length of the back underband segment 218 of the sport bra 100. For instance, in exemplary aspects, the length of the back underband segment 518 may be greater than or equal to a diameter 534 of the opening 536 for the wearer's head as measured from a first lateral side of the opening 536 to a second lateral side of the opening 536. But the length of the back underband segment 518, in exemplary aspects, may be less than the length of the first underband segment 418 as measured from the first end 414 to the second end 416.

In exemplary aspects, the back underband segment 518 may comprise releasable fastener mechanisms 520 and 522 located on the outer-facing surface of the back underband segment 518 adjacent to or near the first end and second end 530 and 532. The releasable fastener mechanisms 520 and 522 are configured to be complementary to the fastener mechanisms 424 of the front underband segment 418. The releasable fasteners 520 and 522 may be generally sized and positioned as shown in FIG. 4 or, optionally, they may extend to the first and second ends 530 and 532. In yet another aspect, the releasable fasteners 520 and 522 may comprise a single strip that runs along the length or substantially along the length of the back underband segment 518. Any and all such aspects, and any variation thereof, are contemplated as being within the scope herein.

Figure 5:
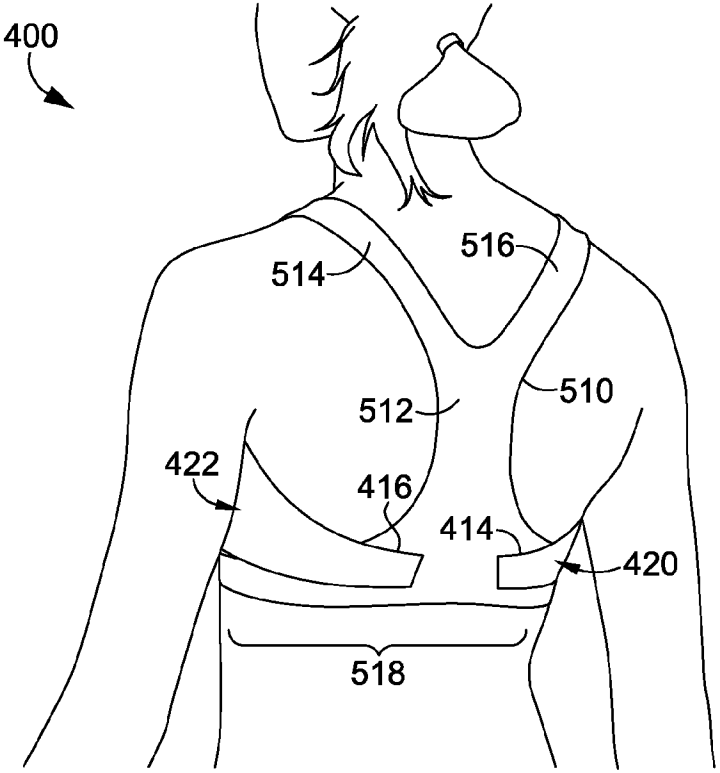
FIG. 5 illustrates a back perspective view of the exemplary sport bra having the adjustable underband tightening assembly of FIG. 4 in an as-worn position in accordance with aspects hereof.

FIG. 5 illustrates a back perspective view of a wearer wearing the exemplary sport bra 400 in accordance with aspects herein. In exemplary aspects, and as shown in FIG. 5, the back underband segment 518 may have a length sufficient to wrap or partially wrap around the sides of the wearer when the bra 400 is worn, although other lengths are contemplated herein. For instance, the back underband segment 518 may have a length such that the first and second ends 530 and 532 may extend generally to an approximate mid-axillary line of the wearer when the sport bra 400 is worn. As also shown in FIG. 5, the wings 420 and 422 of the front underband segment 418 are adapted to wrap around the sides of the wearer towards the back such that an inner-facing surface of the wings 420 and 422 is adjacent to an outer-facing surface of the back underband segment 518. The first end 414 and the second end 416 of the wings 420 and 422 are configured to be releasably and adjustably secured to the back underband segment 518 via the releasable fasteners 424 located on the inner-facing surface of the front underband segment 418 and the releasable fasteners 520 and 522 located on the outer-facing surface of the back underband segment 518. The girth of the sport bra 400 can be increased or decreased by overlaying more or less of the ends 414 and 416 on the back underband segment 518.

Figure 6:
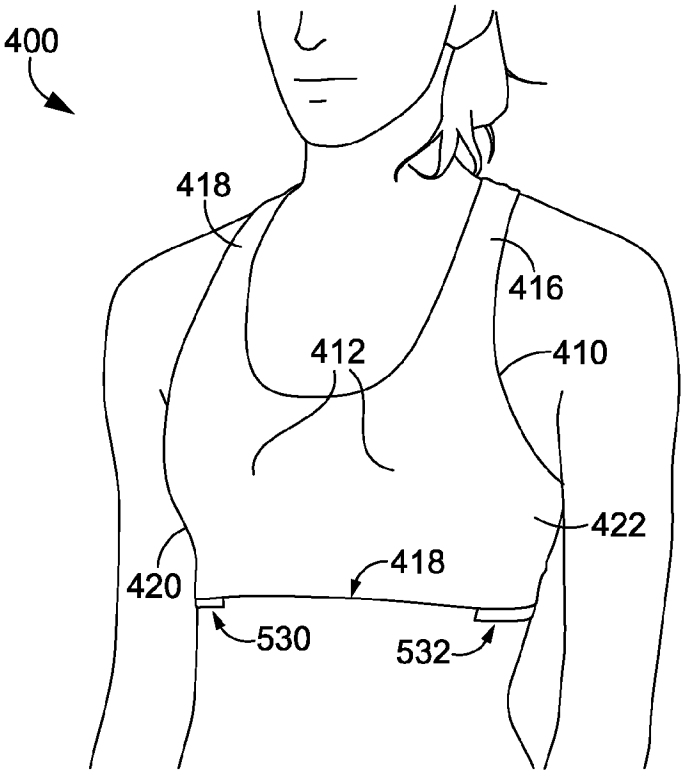
FIG. 6 illustrates a front perspective view of the exemplary sport bra having the adjustable underband tightening assembly of FIG. 4 in the as-worn position in accordance with aspects hereof.

FIG. 6 illustrates a front perspective view of the wearer wearing the exemplary sport bra 400 in accordance with an aspect herein. FIG. 6 is provided to illustrate how the first and second ends 530 and 532 of the back underband segment 518 may be configured to generally extend around the sides of the wearer. In an optional aspect, the releasable fasteners 520 and 522 of the back underband segment 518 may further be mated to the releasable fasteners 424 located on the inner-facing surface of the front underband segment 418. This may help to achieve a higher level of support and/or to facilitate the bra 400 staying in a relatively fixed position during movement.

Figure 7:
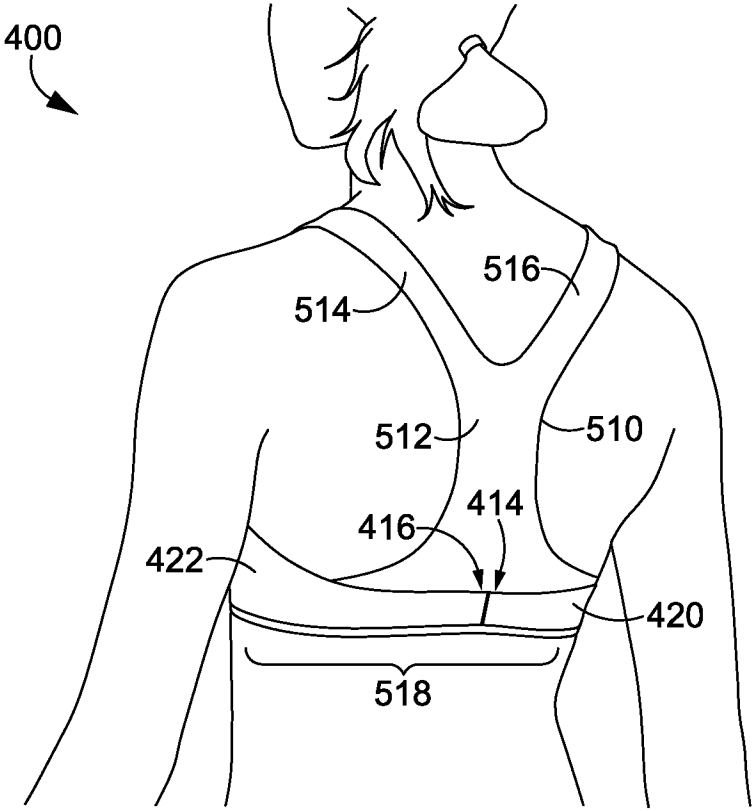
FIG. 7 illustrates a back perspective view of another aspect of the exemplary sport bra having the adjustable underband tightening assembly of FIG. 4 in an as-worn position in accordance with aspects hereof.

FIG. 7 depicts an alternative configuration for the bra 400. In this configuration, instead of the ends 414 and 416 of the front underband segment 418 being releasably and adjustably secured directly to the back underband segment 518 via the releasable fasteners 424 and the releasable fasteners 520 and 522, the ends 414 and 416 of the front underband segment 418 may be releasably and adjustable secured directly to each other using, for instance, a hook-and-eye mechanism or other similar type of mechanisms.

Figure 8:
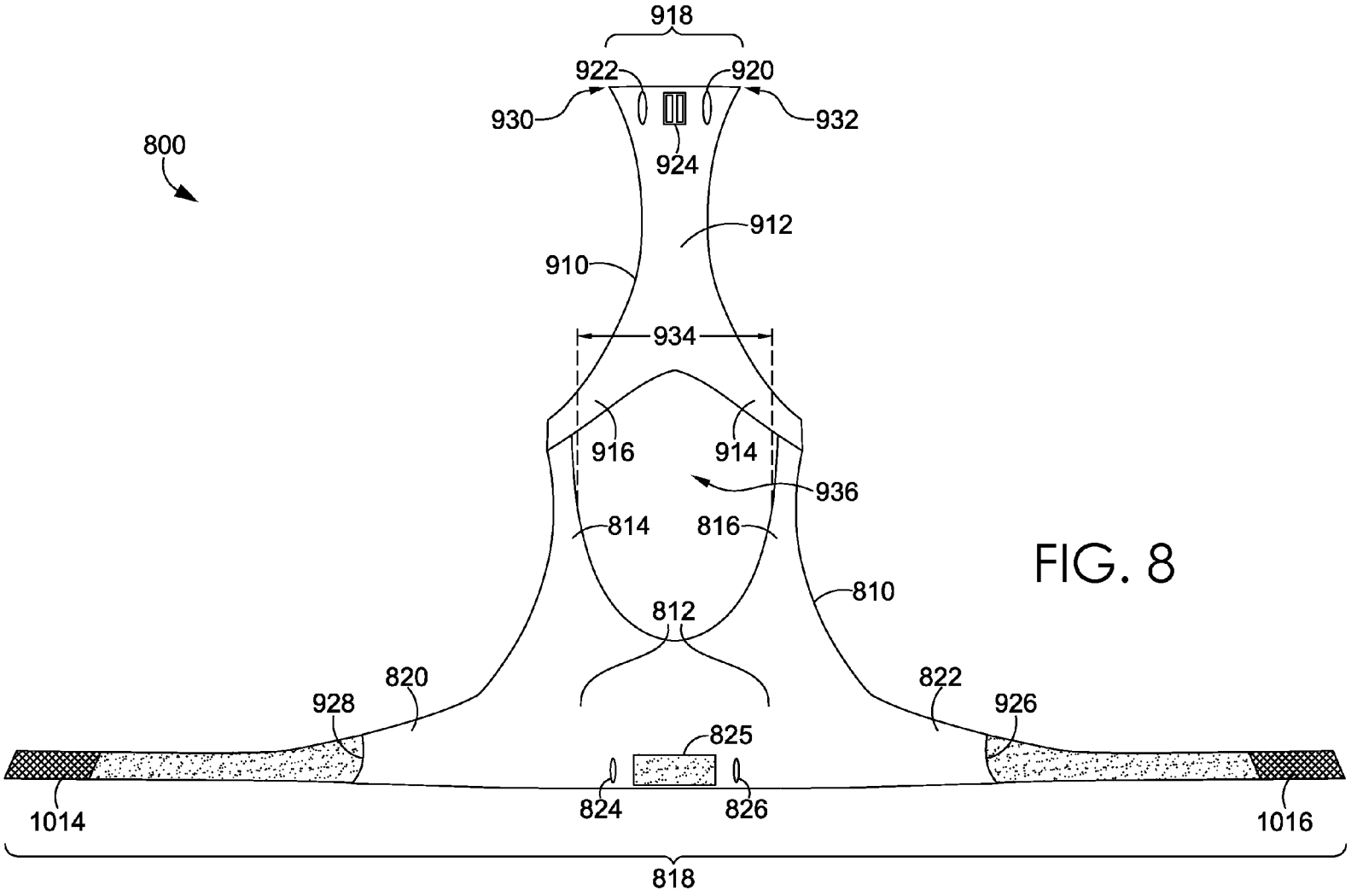
FIG. 8 illustrates a top view of an exemplary wrap back sport bra having an adjustable underband tightening assembly when in an un-assembled and laid-flat configuration in accordance with aspects hereof.
Figure 10:
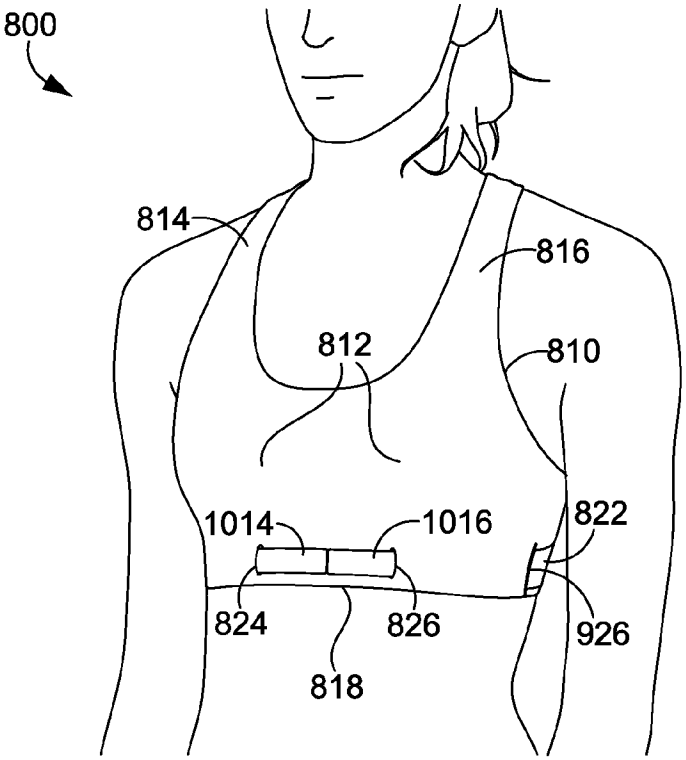
FIG. 10 illustrates a front perspective view of another aspect of the exemplary sport bra having the adjustable underband tightening assembly of FIG. 8 in an as-worn position in accordance with aspects hereof.
Figure 9:
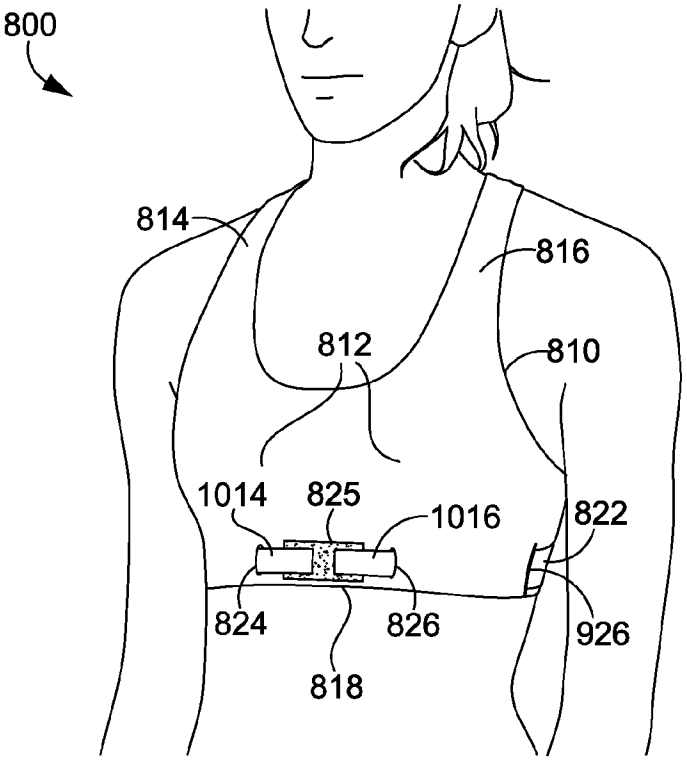
FIG. 9 illustrates a front perspective view of the exemplary sport bra having the adjustable underband tightening assembly of FIG. 8 in an as-worn position in accordance with aspects hereof.

Turning now to FIGS. 8-10, another exemplary aspect of an exemplary sport bra 800 with an adjustable underband tightening assembly is depicted in accordance with aspects herein. FIG. 8 illustrates the sport bra 800 in an un-assembled and laid-flat configuration in accordance with aspects herein. The sport bra 800 shares some similar features as the sport bra 100. As such, the description of these similar features provided with respect to the sport bra 100 is equally applicable to the bra 800. The sport bra 800 comprises a front portion 810 affixed to a back portion 910 via a set of shoulder straps 814, 816, 914, and 916 that define an opening 936 through which a wearer's head can be inserted and/or removed.

The front portion 810 comprises a pair of breast cups 812, a pair of shoulder straps 814 and 816 extending from an upper margin of the breast cups 812, and a front underband segment 818 extending from a lower margin of the breast cups 812. The front underband segment 818 comprises wings 820 and 822 that extend out from respective sides of the front underband segment 818 and terminate in a first end 1014 and a second end 1016 respectively. A releasable fastener mechanism (indicated by the cross-hatching) may be located on an outer-facing surface of each of the ends 1014 and 1016, where the releasable fastener mechanism may comprise any of the releasable fasteners discussed above. In exemplary aspects, the front underband segment 818 including the wings 820 and 822 has a longer length as compared to the front underband segment 118 of FIG. 1. The front underband segment 818 further comprises channels 928 and 926 located on the wings 820 and 822 respectively. In an exemplary aspect, the channels 926 and 928 may generally extend from the opening of the channels 926 and 928 to apertures 824 and 826 (discussed below).

The front underband segment 818 additionally comprises apertures 824 and 826 located on either side of a hypothetical midline bisecting the front portion 810 into two equal right and left halves. The apertures 824 and 826 extend completely through the thickness of the front underband segment 818. The front underband segment 818 may optionally comprise a releasable fastener mechanism 825 located on an outer-facing surface of the front underband segment 818 between the apertures 824 and 826 (i.e., at a midpoint of the front underband segment 818). The releasable fastener 825 may comprise any of the releasable fastener mechanisms described above.

The back portion 910 of the bra 800 is similar to the back portion 210 of FIG. 1. As such, the description of the back portion 210 is equally applicable to the back portion 910. The back portion 910 comprises a central body portion 912 from whose upper margin a set of shoulder straps 914 and 916 extend. A back underband segment 918 extends from the lower margin of the central body portion 912 and terminates in a first end 930 and a second end 932. In exemplary aspects, the length of the back underband segment 918 as measured from the first end 930 to the second end 932 may be less than or equal to a diameter 934 of the opening 936 for the wearer's head as measured from a first lateral side of the opening 936 to a second lateral side of the opening 936. Moreover, in exemplary aspects, the length of the front underband segment 818 as measured from the first end 1014 to the second end 1016 may be greater than the diameter 934 of the opening 936 as measured from the first lateral side to the second lateral side of the opening 936. As such, in exemplary aspects, the length of the front underband segment 818 is greater than the length of the back underband segment 918.

The back underband segment 918 comprises apertures 920 and 922 and a securing means 924. The apertures 920 and 922 extend completely through the material making up the back underband segment 918 and are located on either side of a hypothetical midline that bisects the back portion 910 into two equal right and left halves. In an exemplary aspect, the securing means 924 may comprise a double-loop slide buckle that is affixed to an exterior face of the back underband segment 918 midway between the two apertures 920 and 922 using various affixing technologies known in the art such as stitching, bonding, adhesives, hook-and-loop fasteners and the like. The depiction of the securing means 924 in FIG. 8 is exemplary only and other types of securing means are contemplated as being within the scope herein.

FIG. 9 illustrates a front perspective view of a wearer wearing the sport bra 800 in accordance with aspects described herein. A back view of the wearer wearing the sport bra 800 would be generally similar to that shown in FIG. 3. FIG. 9 is used to illustrate a configuration where the wings 820 and 822 are of a length that after the first and second ends 1014 and 1016 are threaded through the apertures 922 and 920 respectively and the securing means 924 of the back underband segment 918 as described in relation to FIG. 3, the wings 820 and 822 are folded back on themselves and the free ends 1014 and 1016 are threaded through the channels 928 and 926 respectively. After passing through the channels 928 and 926, the free ends 1014 and 1016 are threaded through the apertures 824 and 826 respectively of the front underband segment 818 such that the free ends 1014 and 1016 are positioned on an outer-facing surface of the front underband segment 818. The free ends 1014 and 1016 may then be releasably and adjustably secured to the front underband segment 818. For instance, the releasable fasteners located on the free ends 1014 and 1016 may be releasably and adjustably affixed to the releasable fastener 825 located on the front underband segment 818. The girth of the sport bra 800 may be increased and/or decreased by overlaying more or less of the free ends 1014 and 1016 on the releasable fastener 825.

In another example, and as shown in FIG. 10, the free ends 1014 and 1016 may be releasably and adjustably secured directly to each other using, for example, the releasable fasteners located thereon and/or other type of securing means such as clasps, hook-and-eyes, and the like. In this case, the bra 800 may not comprise the releasable fastener 825. In yet another example, a securing means similar to the securing means 924 on the back underband segment 918 may be used. In this aspect, the free ends 1014 and 1016 may be threaded through the securing means, folded back on themselves, and secured using some type of releasable fastener. Any and all such aspects, and any variation thereof, are contemplated as being within the scope herein. Using this "double-wrap" arrangement may help to more evenly distribute the pressure imposed by the wings 820 and 822 on the wearer, which, in turn, may improve the wearer's comfort and provide better support.

Figure 11:
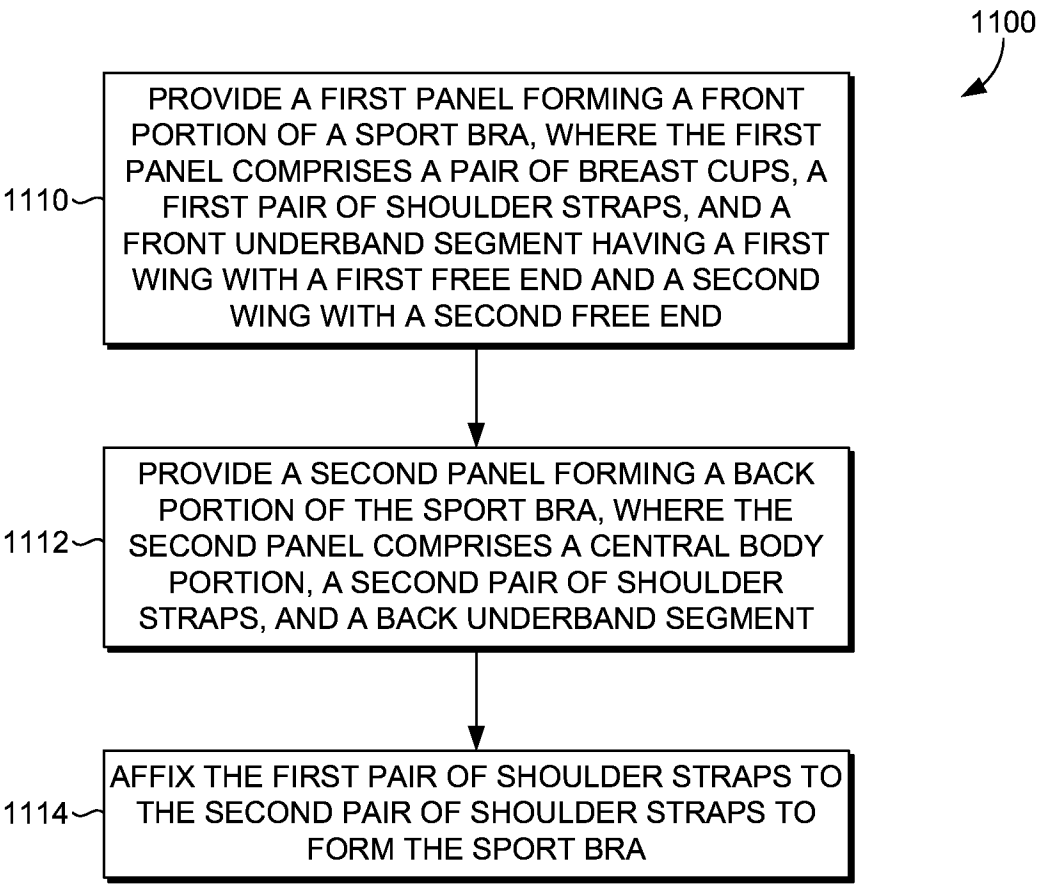
FIG. 11 illustrates a flow diagram of an exemplary method of manufacturing a sport bra having an adjustable underband tightening assembly in accordance with aspects hereof.

Turning now to FIG. 11, a flow diagram of an exemplary method 1100 of manufacturing an exemplary sport bra having the adjustable underband tightening assembly described herein is provided. The exemplary sport bra may comprise the sport bra 100, the sport bra 400, and/or the sport bra 800 described herein. At a first step 1110, a first panel forming a front portion of the sport bra is provided. The first panel comprises a pair of breast cups, a first pair of shoulder straps extending from an upper margin of the breast cups, and a front underband segment extending from a lower margin of the breast cups. In exemplary aspect, the front underband segment comprises a first wing that extends away from a first side of the front underband segment and terminates in a first free end, and a second wing extending away from a second side of the front underband segment and terminating in a second free end.

In exemplary aspects, the front underband segment may comprise one or more releasable fastener mechanisms located on an inner-facing surface and/or an outer-facing surface of the front underband segment. Additionally, the first and second wings of the front underband segment may comprise one or more channels or pockets. As well, the front underband segment may comprise one or more apertures.

At a step 1112, a second panel forming a back portion of the sport bra is provided. The second panel comprises a central body portion, a second pair of shoulder straps extending from an upper margin of the central body portion, and a back underband segment extending from a lower margin of the central body portion and having a first end and a second end. The back underband segment, in exemplary aspects, may comprise one or more releasable fastener mechanisms and/or one or more apertures.

At a step 1114, the first panel forming the front portion of the sport bra is affixed to the second panel forming the back portion of the sport bra to form the sport bra. More specifically, the first pair of shoulder straps is affixed to the second pair of shoulder straps to form the sport bra. Once affixed, the first pair of shoulder straps and the second pair of shoulder straps define an opening having a diameter as measured from a first lateral side of the opening to a second lateral side of the opening. In an alternative method of manufacture, the first and second panels may be formed as a single piece of engineered fabric via, for instance, a knitting or weaving process. In this aspect, there would be no need to affix the shoulder straps to each other as they would comprise a single construction. Moreover, with respect to this method of manufacture, the apertures and channels may be integrally formed through the knitting or weaving process used to form the bra.

In exemplary aspects, the first panel is formed such that the front underband segment has a length greater than the diameter of the opening as measured from the first lateral side of the opening to the second lateral side of the opening. As well, the second panel is formed such that the back underband segment has a length less than, equal to, or slightly greater than the diameter of the opening as measured from the first lateral side of the opening to the second lateral side of the opening. Continuing, in exemplary aspects, the length of the front underband segment is longer than the length of the back underband segment.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A sport bra with an adjustable underband tightening assembly, the sport bra comprising:

a front portion adapted to cover a wearer's breasts and at least a portion of the wearer's torso when the sport bra is in an as-worn configuration, the front portion comprising at least:

a pair of breast cups, a first pair of shoulder straps extending from an upper margin of the pair of breast cups, and a front underband segment extending from a lower margin of the pair of breast cups and adapted to cover the portion of the wearer's torso when the sport bra is in the as-worn configuration, wherein the front underband segment comprises a first wing and a second wing extending away from respective sides of the front underband segment, and wherein the first wing terminates in a first free end and the second wing terminates in a second free end, wherein a releasable fastener mechanism is located on the first free end of the first wing and the second free end of the second wing; and a back portion adapted to cover at least a portion of the wearer's back when the sport bra is in the as-worn configuration, the back portion comprising at least:

a central body portion adapted to cover a portion of the wearer's back when the sport bra is in the as-worn configuration, a second pair of shoulder straps extending from an upper margin of the central body portion, the second pair of shoulder straps secured to the first pair of shoulder straps to define an opening through which the wearer's head is inserted or removed when the sport bra is donned or doffed, and a back underband segment extending from a lower margin of the central body portion, the back underband segment having a third end and a fourth end configured to terminate at respective sides of a back midline of the wearer when the sport bra is in the as-worn configuration, the back underband segment comprising: 1) a first aperture, 2) a second aperture, and 3) a securing means, wherein:

the first and second wings are adapted to wrap around respective side torso areas of the wearer such that the first free end of the first wing can be received by the first aperture and the securing means and the second free end of the second wing can be received by the second aperture and the securing means, after being received by the first aperture and the securing means, the releasable fastener mechanism located at the first free end of the first wing is useable for releasably and adjustably securing the first free end to a complementary releasable fastener mechanism located on the first wing, and after being received by the second aperture and the securing means, the releasable fastener mechanism located at the second free end of the second wing is useable for releasably and adjustably securing the second free end to a complementary releasable fastener mechanism located on the second wing.

2. The sport bra of claim 1, wherein the first and second apertures are located on opposite sides of the back midline of the wearer when the sport bra is in the as-worn configuration.

3. The sport bra of claim 1, wherein the releasable fastener mechanism comprises one or more of hook-and-loop fasteners, hook-and-eye fasteners, releasable adhesives, buttons, or snaps.

4. The sport bra of claim 1, wherein the securing means is located midway between the first and second apertures on an outer-facing surface of the back underband segment.

5. The sport bra of claim 4, wherein the securing means comprises a double-loop slide buckle.

6. The sport bra of claim 1, wherein both the first and second wings comprise a pocket or channel.

7. A sport bra with an adjustable underband tightening assembly, the sport bra comprising:

a front portion adapted to cover a wearer's breasts and at least a portion of the wearer's torso when the sport bra is in an as-worn configuration, the front portion comprising at least:

a pair of breast cups, a first pair of shoulder straps extending from an upper margin of the pair of breast cups, and a front underband segment extending from a lower margin of the pair of breast cups and adapted to cover the portion of the wearer's torso when the sport bra is in the as-worn configuration, wherein the front underband segment comprises a first wing and a second wing extending away from respective sides of the front underband segment, and wherein the first wing terminates in a first free end having a releasable fastener mechanism located thereon and the second wing terminates in a second free end having a releasable fastener mechanism located thereon, and wherein the front underband segment further comprises a first aperture and a second aperture; and a back portion adapted to cover at least a portion of a wearer's back when the sport bra is in an as-worn configuration, the back portion comprising at least:

a central body portion adapted to cover a portion of the wearer's back when the sport bra is in the as-worn configuration, a first pair of shoulder straps extending from an upper margin of the central body portion, and a back underband segment extending from a lower margin of the central body portion, the back underband segment having a third end and a fourth end configured to terminate at respective sides of a back midline of the wearer when the sport bra is in the as-worn configuration, the back underband segment comprising: 1) a third aperture, 2) a fourth aperture, and 3) a securing means, wherein:

the first and second wings are adapted to wrap around respective side torso areas of the wearer such that the first free end of the first wing can be received by the third aperture and the securing means, and the second free end of the second wing can be received by the fourth aperture and the securing means, after being received by the third and fourth apertures and the securing means, the first and second wings are adapted to wrap around the respective side torso areas of the wearer such that the first free end of the first wing can be received by the first aperture of the front underband segment, and the second free end of the second wing can be received by the second aperture of the front underband segment, after being received by the first aperture, the releasable fastener mechanism located at the first free end of the first wing is useable for releasably and adjustably securing the first free end to a complementary releasable fastener mechanism located on one of the second wing or located on the front underband segment, and after being received by the second aperture, the releasable fastener mechanism located at the second free end of the second wing is useable for releasably and adjustably securing the second free end to a complementary releasable fastener mechanism located on one of the first wing or located on the front underband segment.

8. The sport bra of claim 7, wherein the first aperture and the second aperture are located adjacent to a hypothetical midline bisecting the front portion into equal right and left halves.

9. The sport bra of claim 7, wherein the third aperture and the fourth aperture are located adjacent to the back midline of the wearer when the sport bra is in the as-worn configuration.

10. The sport bra of claim 9, wherein the securing means is located between the third aperture and the fourth aperture.

11. The sport bra of claim 7, wherein the first wing and the second wing each comprise a pocket or channel.

12. A sport bra with an adjustable underband tightening assembly, the sport bra comprising:

a front portion comprising at least:

a pair of breast cups, a first pair of shoulder straps extending from an upper margin of the pair of breast cups, and a front underband segment extending from a lower margin of the pair of breast cups, wherein the front underband segment comprises a first wing and a second wing extending away from respective sides of the front underband segment, and wherein the first wing terminates in a first free end having a releasable fastener mechanism located thereon and the second wing terminates in a second free end having a releasable fastener mechanism located thereon; and a back portion comprising at least:

a central body portion, a second pair of shoulder straps extending from an upper margin of the central body portion, the second pair of shoulder straps secured to the first pair of shoulder straps to define an opening, and a back underband segment extending from a lower margin of the central body portion, the back underband segment having a third end and a fourth end, wherein a length of the back underband segment as measured from the third end to the fourth end is less than a length of the front underband segment as measured from the first free end to the second free end, wherein:

the first wing is adapted to wrap around a respective side torso area of a wearer when the sport bra is in an as-worn configuration such that the releasable fastener mechanism located at the first free end of the first wing is useable for releasably and adjustably securing the first free end to one of a complementary releasable fastener mechanism located on the back underband segment or a complementary releasable fastener mechanism located on the second wing, and the second wing is adapted to wrap around a respective side torso area of the wearer when the sport bra is in the as-worn configuration such that the releasable fastener mechanism located at the second free end of the second wing is useable for releasably and adjustably securing the second free end to one of the complementary releasable fastener mechanism located on the back underband segment or a complementary releasable fastener mechanism located on the first wing.

13. The sport bra of claim 12, wherein the length of the back underband segment as measured from the third end to the fourth end is less than or equal to a diameter of the opening defined by the first pair of shoulder straps and the second pair of shoulder straps as measured from a first lateral side of the opening to a second lateral side of the opening.

14. The sport bra of claim 12, wherein the length of the back underband segment as measured from the third end to the fourth end is equal to or greater than a diameter of the opening defined by the first pair of shoulder straps and the second pair of shoulder straps as measured from a first lateral side of the opening to a second lateral side of the opening.

15. The sport bra of claim 12, wherein the length of the front underband segment as measured from the first free end to the second free end is greater than a diameter of the opening defined by the first pair of shoulder straps and the second pair of shoulder straps as measured from a first lateral side of the opening to a second lateral side of the opening.

16. The sport bra of claim 12, wherein the first pair of shoulder straps are one of releasably attached or fixedly attached to the second pair of shoulder straps.

* * * * *